428-408
9/28/82 XR 4,351,412

United States Patent [19]
Yamamuro et al.
[11] 4,351,412
[45] Sep. 28, 1982

[54] DIAPHRAGM FOR ACOUSTIC INSTRUMENTS AND METHOD OF MANUFACTURING THE SAME

[75] Inventors: Isao Yamamuro, Tokorozawa; Tsunehiro Tsukagoshi, Ohmori-nishi, both of Japan

[73] Assignee: Pioneer Electronic Corporation, Tokyo, Japan

[21] Appl. No.: 97,989

[22] Filed: Nov. 28, 1979

[30] Foreign Application Priority Data

Nov. 30, 1978 [JP] Japan ..... 53-147217

[51] Int. Cl.[3] ..... G10K 13/00
[52] U.S. Cl. ..... 181/170; 428/408
[58] Field of Search ..... 181/157, 166, 167, 170, 181/174, 180, DIG. 1, 144–156; 428/408, 402, 403, 367, 116; 179/181 F, 115.5 R; 260/42.17

[56] References Cited

U.S. PATENT DOCUMENTS

| | | | |
|---|---|---|---|
| 2,308,305 | 1/1943 | Reynolds | 428/408 X |
| 3,399,103 | 8/1968 | Salyer et al. | 428/116 |
| 3,399,104 | 8/1968 | Ball et al. | 428/116 |
| 3,404,061 | 10/1968 | Shane et al. | 428/408 X |
| 3,416,992 | 12/1968 | Amos | 428/408 |
| 3,674,109 | 7/1972 | Murase | 181/170 |
| 3,922,412 | 11/1975 | Yoshikawa et al. | 428/408 X |
| 4,035,536 | 7/1977 | Morrison | 428/116 |
| 4,146,668 | 3/1979 | Dorey et al. | 428/408 X |
| 4,198,550 | 4/1980 | Matsuda et al. | 181/170 X |

FOREIGN PATENT DOCUMENTS

| | | | |
|---|---|---|---|
| 53-24811 | 7/1978 | Japan | 181/169 |
| 55-115796 | 9/1980 | Japan | 181/170 |
| 2011310 | 7/1979 | United Kingdom . | |

*Primary Examiner*—Benjamin R. Fuller
*Attorney, Agent, or Firm*—Armstrong, Nikaido, Marmelstein & Kubovcik

[57] ABSTRACT

A honeycomb shaped diaphragm for use in acoustic instruments such as speakers is manufactured by kneading a mixture of flaky graphite powder and thermoplastic resin, preferably polyvinyl chloride, rolling the mixture into a plate, forming honeycomb recesses in the plate, and mating two recessed plates with each other so that the corresponding recesses form closed cavities. The formed plate may be carbonized before assembly. The resultant diaphragm shows a high Young's modulus, a low apparent density and a remarkably high specific modulus of elasticity ensuring improved acoustic characteristics.

15 Claims, 6 Drawing Figures

DIAPHRAGM FOR ACOUSTIC INSTRUMENTS AND METHOD OF MANUFACTURING THE SAME

BACKGROUND OF THE INVENTION

This invention relates to a diaphragm for use in acoustic instruments such as speakers and microphones. This invention also pertains to a method of manufacturing an acoustic diaphragm.

To improve the performance of acoustic diaphragms, attempts have been made to reduce the density and increase the Young's modulus for materials from which diaphragms are made. One example is a honeycomb structure having a honeycomb core sandwiched between skins. The advantages of the honeycomb structure are light weight and rigidity. In the prior art, aluminum or fibrous carbon in a resinous matrix is used for the skin and aluminum is often used for the honeycomb core. Since these structures have a relatively large mass, and particularly a low specific modulus of elasticity $E/\rho$ (E is Young's modulus and $\rho$ is density) in the case of resin-bonded carbon fiber, the acoustic characteristics of the resulting diaphragms are not satisfactory. Furthermore, it is actually very difficult to form a honeycomb core from aluminum without a special complicated technique. This increases the cost of aluminum honeycomb diaphragms.

SUMMARY OF THE INVENTION

It is a primary object of this invention to provide a diaphragm for use in acoustic instruments which has improved acoustic characteristics.

Another object of this invention is to provide a method of manufacturing an acoustic diaphragm in a simple manner at low cost.

A diaphragm for use in an acoustic instrument according to this invention comprises a body of a kneaded mixture of flaky graphite powder and thermoplastic resin. The terminology "flaky graphite powder" is utilized in the present specification to mean a flaky graphite in powder form. The body includes a plurality of closed interior cavities therein. The cavities contain air and are partitioned by a rib which preferably extends transverse to the surface of the body, preferably in the form of a plate.

The flaky graphite powder has a diameter of 0.1 to 100 microns, preferably a diameter of 0.1 to 5 microns. The mixture includes 10 to 90 parts by weight of flaky graphite powder and 90 to 10 parts by weight of the resin. The preferred mixture includes 30 to 70 parts by weight of flaky graphite powder and 70 to 30 parts by weight of the resin. Smaller amounts of graphite are insufficient to improve Young's modulus while larger amunts result in fragile products. The flaky graphite powder is blended with the thermoplastic resin in a suitable ratio within the above range and the mixture is thoroughly kneaded by means of any suitable well-known kneader. Preferably, kneading is carried out at the softening point of the resin used. The resulting mixture is ready for use to mold a diaphragm element. Preferably, the mixture is rolled into a plate so as to orient the graphite flakes in parallel with the surface of the plate since the orientation of flakes in the resin matrix can increase the Young's modulus of tthe resulting plate.

The thermoplastic resins which can be used in this invention include polyvinyl chloride, polyvinylidene chloride, vinyl chloride-acrylonitrile copolymers, vinylidene chloride-acrylonitrile copolymers, vinyl chloride-vinyl acetate copolymers, and mixtures thereof.

The mixture according to this invention may further contain effective amounts of a plasticizer and a stabilizer.

BRIEF DESCRIPTION OF THE DRAWING

The above and other objects and advantages of the invention will become apparent from the following discussion of the accompanying drawings, wherein.

DETAILED DESCRIPTION OF THE PREFERRED EMBODIMENTS

Figure 1:
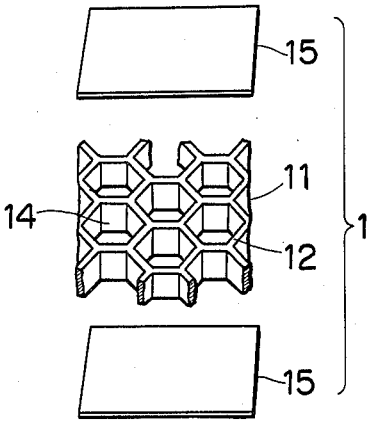
FIG. 1 is an exploded perspective view of a first embodiment of a diaphragm according to this invention.

Referring to FIG. 1, there is shown a honeycomb structured acoustic diaphragm according to a first embodiment of this invention. The structure itself is known in the art. The diaphragm designated by numeral 1 comprises a honeycomb core 11 having open hexagonal cavities 14 partitioned by a rib 12. The core 11 is sandwiched by two skins 15 and 15.

According to this invention, the honeycomb core 11 is prepared by blending flaky graphite powder with polyvinyl chloride (to be referred to as "PVC", hereinafter) and molding the blend by any conventional process such as press molding, injection molding and compression molding. In a preferred embodiment, 20 parts by weight of flaky graphite powder is blended and kneaded with 10 parts by weight of PVC and the resulting blend is compression molded into a honeycomb structure. Compression molding permits graphite flakes to be oriented in the resin, imparting high rigidity to the resulting core 11. In the most preferred embodiment, the blend is rolled into a sheet, such rolled sheets are laminated and hot pressed into a laminate plate, and the plate is punched to form a honeycomb core. After molding, the honeycomb core may be pre-sintered by heating it at a temperature of 250° C. in an oxidizing atmosphere. The core may then be carbonized by heating it to a temperature of 1,200° C. in a non-oxidizing atmosphere. The carbonized core has a Young's modulus of 6,000–8,000 kg/mm$^2$ and a density of about 1.7 g/cm$^3$. The ratio of Young's modulus to density or specific modulus of elasticity of the carbonized core is about 1.5 times higher than aluminum.

The skin 15 is prepared by rolling the same blend as prepared for the core 11 into a flat plate. Extrusion molding or other molding methods may be employed to prepare a flat plate. However, the plates prepared by extrusion molding the blend of flaky graphite powder and PVC show a somewhat reduced Young's modulus since graphite flakes are not oriented in the resin. Rolling can orient graphite flakes in the plate and thus increase the Young's modulus. Therefore, rolling is the best method for preparing a flat plate for the skin 15.

For example, 20 parts by weight of flaky graphite powder is thoroughly kneaded with 10 parts by weight of PVC and the resulting blend is rolled into a plate which shows a Young's modulus of 6,000 kg/mm$^2$, a density of 1.8 g/cm$^3$, a specific modulus of $3.3\times10^9$ mm, and an internal loss (tanδ) of 0.05. This means that the rolled plate is about 1.3 times higher in specific modulus than aluminum which has a Young's modulus of 7,000 kg/mm$^2$, a density of 2.7 g/cm$^3$, and a specific modulus of $2.6\times10^9$ mm. A higher specific modulus indicates that sound is transmitted through the plate at a higher speed and piston motion is available up to a higher frequency range. The internal loss of the plate which is larger by one order than the internal loss of aluminum of 0.003 results in a flatter frequency response.

The Young's moduls of a plate of the above-formulated mixture may be significantly increased by carbonization. To this end, the plate is first pre-sintered and made infusible, for example, by heating it to a temperature of 100° to 500° C. at a rate of 1°-20° C. per hour in an oxidizing atmosphere, preferably in air. Then the plate is heated to a temperature of 500° to 1500° C., preferably 1000° to 1500° C. at a rate of 1°-20° C. per hour, preferably 10°-20° C. per hour in an inert atmosphere to achieve carbonization or graphitization. The carbonized plate of this example has a Young's modulus of 16,000 kg/mm$^2$, a density of 1.7 g/cm$^3$, a specific modulus of $9.4\times10^9$ mm, and an internal loss (tanδ) of 0.009. This shows a significant increase in specific modulus with a reduction in internal loss.

The core 11 is sanwiched and sealed between the skins 15 and 15 via adhesive interfaces (not shown), obtaining a honeycomb assembly ready for use as an acoustic diaphragm. The openings 14 are closed by skins 15 in the assembly.

Figure 2:
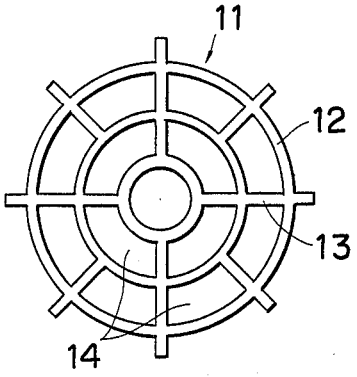
FIG. 2 is a plan view showing a core used in another embodiment of a diaphragm according to this invention.

FIG. 2 shows another core 11 having a pattern of concentric circles and radial arms. The core 11 comprises concentric annular ribs 12 and radially extending arms or ribs 13 which cooperate to form open cavities 14. Such cores may be press molded, injection molded, or compression molded from a blend according to this invention. A mold may be prepared by cutting concentric annular channels by means of a lathe and by milling radial channels in a mold member.

Figure 3A:
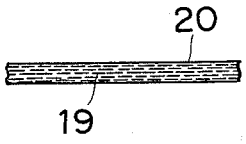
FIGS. 3*a* to 3*d* are views of elements in various steps of diaphragm preparation according to this invention, FIG. 3*a* being a cross section of a starting plate, FIG. 3*b* being a plan view of a molded half, FIG. 3*c* being a cross section of the molded half viewed along line C—C of FIG. 3*b*, and FIG. 3*d* being a cross section of a diaphragm completed by mating two molded halves.

A third embodiment of the diaphragm of this invention is shown in FIGS. 3*a* to 3*d*. This embodiment has a honeycomb structures similar to that of FIG. 1, but comprises different elements. FIG. 3*a* shows a flat plate 20 which is prepared by rolling a blend of flaky graphite powder and a resin as in the foregoing embodiments. Graphite flakes 19 are shown as being oriented in parallel with the surface of the plate 20. Simply blending flaky graphite with the resin cannot orient graphite flakes. Rolling is carried out as in the first embodiment shown in FIG. 1 to provide orientation of graphite flakes, thereby improving the specific modulus of the plate. The plate 21 is relatively thick so that recesses 23 having a given depth may be formed on a skin portion 25 having a given thickness in the subsequent molding step. The plate 20 may be either a single plate or an integrated multi-layer plate. In the latter case a plurality of thin sheets may be placed one on another and then hot pressed to form an integrated multi-layer plate having a given thickness.

Figure 3B:
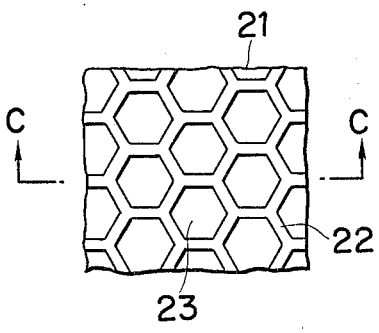
Figure 3C:
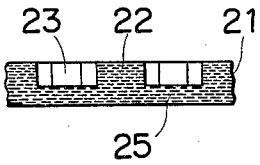

In the next step, the plate 20 is heat pressed between an upper mold having hexagonal projections in a honeycomb pattern and a lower mold having a flat surface, obtaining a honeycomb half 21 as shown in FIGS. 3*b* and 3*c*. The honeycomb half 21 has a rib 22 defining hexagonal open recesses 23 on a skin portion 25. During press molding, part of the surface layer of the plate 20 is moved aside to form a portion of the rib 22. The remaining portion maintains orientation of graphite flakes although pressed denser particularly at areas underlying the recesses. No reduction of Young's modulus occurs in the skin portion 25 which will form a skin of a diaphragm after assembly.

The honeycomb half 21 may or may not be heat treated before it is assembled in the next step. If desired, the honeycomb half 21 is pre-sintered by heating to 250° C. in air and then carbonized by heating to 1,200° C. in a non-oxidizing atmosphere. The carbonization increases the Young's modulus significantly as described in the foregoing.

Figure 3D:
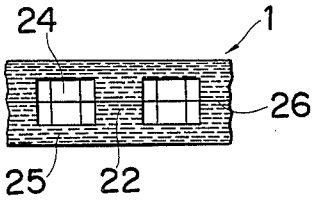

Two honeycomb halves shown in FIGS. 3*a* and 3*c* are then mated into a honeycomb assembly 1 shown in FIG. 3*d* by abutting the top surfaces of the ribs 22 with each other via an adhesive interface 26. The honeycomb assembly 1 consisting of two halves 21 joined at the interface 26 includes a plurality of cavities 24 which are partitioned by the rib 22 and closed by the skin portion 25.

The first embodiment shown in FIG. 1 uses one core and two skins and requires two adhesive applications to attach two skins to either surface of the core. The third embodiment shown in FIG. 3 requires one application of adhesive and one mold, contributing to a reduction of working time and fabrication steps. Accordingly, the third embodiment is more advantageous than the first embodiment.

The essential requirement for acoustic diaphragms is a reduction of weight for improving acoustic characteristics. This means that the weight of an adhesive is an important factor. As the area of an adhesive interface increases, the amount of adhesive applied increases and the risk of non-uniform application will increase. Non-uniform adhesion will deteriorate acoustic characteristics. The first embodiment includes two adhesive interfaces while the third embodiment includes one adhesive interface. The latter case is more advantageous in this respect too. It is to be noted that an adhesive is not necessary when elements to be bonded are not carbonized. Non-carbonized elements can be hot pressed into an assembly.

In the foregoing embodiment, the diaphragm includes cavities of a hexagonal form or a ring segment form. However, cavity form is not limited thereto and may be of a triangular or rectangular form, for example.

Also, the rib is not limited to a honeycomb pattern. The rib may take a pattern as shown in FIG. 2 or a triangular or rectangular pattern. The pattern may be varied insofar as the rib of one half mates with that of the other half in the case of embodiments as shown in FIG. 3.

Further, the foregoing embodiments all relate to flat diaphragms. The diaphragm may also be of a cone or dome shape. Those skilled in the art will select a suitable mold depending on the desired shape and the molding method employed. For example, a cone-shaped diaphragm may be readily obtained by re-forming a plate-shaped diaphragm prepared as above into a cone shape.

This invention will be more fully understood with reference to the following Examples.

EXAMPLE 1

| Ingredient | Parts by weight |
|---|---|
| Polyvinyl chloride | 10 |
| Graphite | 20 |
| Stabilizer (lead stearate) | 0.3 |
| Plasticizer (BPBG) | 1.0 |

These ingredients all in the form of powder were kneaded at a temperature of 150° C. and then rolled into a sheet having a thickness of 1.0 mm. Three sheets were placed one on the other and hot pressed to form an intregrated laminate plate. The laminate plate was punched by means of a press having a honeycomb configuration at a temperature of 100° C. to form a honeycomb core similar to the core 11 shown in FIG. 1.

The honeycomb core was sandwiched between two sheets as rolled above (each having a thickness of 1.0 mm) and then hot pressed to complete the assembly which had a final thickness of 5.0 mm.

EXAMPLE 2

A sheet having a thickness of 1.0 mm as rolled in Example 1 was subjected to carbonization. The sheet was first pre-sintered and oxidized by heating it to a temperature of 250° C. at a rate of 1°-10° C./hour in an oxidizing atmosphere, and then carbonized by heating it to a temperature of 1000° C. at a rate of 10°-20° C./hour in an inert atmosphere.

Two carbonized sheets were attached to either surface of a honeycomb core as punched in Example 1 by applying an adhesive to the interface therebetween.

EXAMPLE 3

Two sheets as rolled in Examle 1 were hot pressed to form an integrated laminate plate. The laminate plate was pressed by means of a honeycomb pattern press to form a honeycomb half similar to the half 21 shown in FIGS. 3*b* and 3*c*. Two halves were mated and hot pressed into honeycomb assembly as shown in FIG. 3*d*.

EXAMPLE 4

A honeycomb half as pressed in Example 3 was carbonized in the same manner as described in Example 2. Two carbonized halves were bonded using an adhesive, obtaining a honeycomb assembly.

As described in the foregoing, the acoustic diaphragm of this invention is made of a kneaded mixture of flaky graphite powder and a thermoplastic resin and has a structure including a plurality of closed interior cavities partitioned by an interior rib. The cavities contain air and are defined by the rigid rib. The mixture of graphite and a thermoplastic resin is not only readily rolled into a sheet, but also readily molded by press molding, injection molding, compression molding or the like. Accordingly, the diaphragm of this invention can be easily manufactured with a relatively small number of steps. The diaphragm has high rigidity due to the internal rib, a low apparent density due to the air-containing interior cavities, and a high specific modulus of elasticity $E/\rho$ due to an increase of Young's modulus and a reduction of density attributed to the presence of flaky graphite powder.

When employed in speakers, the diaphragms according to this invention have an extended reproduction range and improved acoustic characteristics including distortion and transient response.

What is claimed is:

1. A diaphragm for use in an acoustic instrument comprising a body of a kneaded mixture consisting essentially of 10–90 parts by weight of flaky graphite powder and 90–10 parts by weight of a thermoplastic resin, said body including a plurality of closed interior cavities partitioned by an interior rib.

2. A diaphragm according to claim 1 wherein said flaky graphite powder are oriented in the resin in parallel with the surface of the body at least at the surface portion thereof.

3. A diaphragm according to claim 1 or 2 wherein said rib defining the cavities has a honeycomb pattern.

4. A diaphragm according to claim 1 or 2 wherein said rib defining the cavities has a pattern of concentric circles linked with radial arms.

5. A diaphragm according to claim 3 wherein said kneaded mixture of flaky graphite powder and a thermoplastic resin is carbonized.

6. A diaphragm according to claim 4 wherein said body is a plate having a flat surface.

7. A diaphragm for use in an acoustic instrument comprising two flat plates, and a rib member having two parallel main surfaces and provided with a plurality of openings transverse to the main surfaces, said rib member being sandwiched and sealed between said plates with the main surface abutting the inner surface of the plate so that said openings are closed by the plates, said plates and rib member being made of a kneaded mixture consisting essentially of flaky graphite powder and a thermoplastic resin.

8. A diaphragm for use in an acoustic instrument comprising two segments each made of a kneaded mixture consisting essentially of flaky graphite powder and a thermoplastic resin, having two flat main surfaces and provided at one main surface with a plurality of recesses, said segments mating with each other at their one main surfaces so that the corresponding recesses form closed cavities.

9. A diaphragm according to any one of claims 1, 2, 7 or 8 wherein said flaky graphite powder has a diameter of 0.1 to 100 microns.

10. A diaphragm according to claim 9 wherein said flaky graphite powder has a diameter of 0.1 to 5 microns.

11. A diaphragm according to claim 1 wherein said mixture includes 30–70 parts by weight of graphite and 70–30 parts by weight of the resin.

12. A diaphragm according to any one of claims 1, 2, 7 or 8 wherein said thermoplastic resin is selected from the group consisting of polyvinyl chloride, polyvinylidene chloride, vinyl chloride-acrylonitrile copolymers, vinylidene chloride-acrylonitrile copolymers, vinyl chloride-vinyl acetate copolymers, and mixtures thereof.

13. A diaphragm according to claim 12 wherein said thermoplastic resin is polyvinyl chloride.

14. A diaphragm according to claim 4 wherein said kneaded mixture of flaky graphite powder and a thermoplastic resin is carbonized.

15. A diaphragm according to claim 14 wherein said body is a plate having a flat surface.

* * * * *